US009019169B2

(12) United States Patent
Wu

(10) Patent No.: US 9,019,169 B2
(45) Date of Patent: Apr. 28, 2015

(54) ANTENNA MODULE

(75) Inventor: San-Yuan Wu, New Taipei (TW)

(73) Assignee: Lynwave Technology, Ltd., New Taipei (TW)

( * ) Notice: Subject to any disclaimer, the term of this patent is extended or adjusted under 35 U.S.C. 154(b) by 192 days.

(21) Appl. No.: 13/251,969

(22) Filed: Oct. 3, 2011

(65) Prior Publication Data

US 2012/0105301 A1 May 3, 2012

(30) Foreign Application Priority Data

Oct. 27, 2010 (TW) ..... 99220795 U

(51) Int. Cl.

| | |
|---|---|
| ***H01Q 21/24*** | (2006.01) |
| ***H01Q 21/30*** | (2006.01) |
| ***H01Q 9/42*** | (2006.01) |
| ***H01Q 5/00*** | (2006.01) |

(52) U.S. Cl.
CPC ..... *H01Q 9/42* (2013.01); *H01Q 5/0058* (2013.01); *H01Q 21/30* (2013.01)

(58) Field of Classification Search
CPC ..... H01Q 21/24
USPC ..... 343/893
See application file for complete search history.

(56) References Cited

U.S. PATENT DOCUMENTS

| | | | | |
|---|---|---|---|---|
| 6,812,902 | B2 * | 11/2004 | Rossman et al. | 343/725 |
| 2003/0210204 | A1 * | 11/2003 | Chiang et al. | 343/893 |
| 2004/0108966 | A1 * | 6/2004 | McKivergan et al. | 343/895 |
| 2005/0068234 | A1 * | 3/2005 | Hung et al. | 343/702 |
| 2006/0038721 | A1 * | 2/2006 | Ozkar et al. | 343/700 MS |
| 2008/0136715 | A1 * | 6/2008 | Shtrom et al. | 343/702 |
| 2010/0182204 | A1 * | 7/2010 | Hao et al. | 343/702 |

* cited by examiner

*Primary Examiner* — Dameon E Levi
*Assistant Examiner* — Andrea Lindgren Baltzel
(74) *Attorney, Agent, or Firm* — Muncy, Geissler, Olds & Lowe, P.C.

(57) ABSTRACT

An antenna module includes a center base and several antennas disposed around the center base. The center base has several extension legs extending from the center base, and each antenna extends from an end of the corresponding extension leg opposite to the center base, so as to form the antenna module symmetrically arranged around the center base. The type of the antenna may be a single-frequency antenna and a dual-frequency antenna. The antenna module is an integral structure formed by directly bending a single metal plate, thus greatly reducing the volume and the manufacturing cost of the antenna module. Moreover, with the design of the center base and a symmetrical antenna group, the antenna module is capable of receiving and transmitting signals with two or more frequency bands, thus greatly increasing the application range of the antenna module.

11 Claims, 2 Drawing Sheets

ANTENNA MODULE

CROSS-REFERENCE TO RELATED APPLICATIONS

This non-provisional application claims priority under 35 U.S.C. §119(a) on Patent Application No(s). 099220795 filed in Taiwan, R.O.C. on Oct. 27, 2010, the entire contents of which are hereby incorporated by reference.

BACKGROUND

1. Technical Field

The disclosure relates to an antenna module, and more particularly to an antenna module with several antennas symmetrically disposed around a center base.

2. Related Art

In recent years, with the popularization of consumer electronic products such as notebook computers and Personal Digital Assistants (PDA) and the rapid development of the Internet, information from different regions in the world is communicated and linked. Today, the interconnection architecture of the Internet is changed from a wired connection type such as using optical fibers, wires or cables, to a wireless connection type, so as to solve the problem that circuit layout of the network architecture of the wireless type is too complicated, and provide a humanized and convenient communication environment.

Due to the application of the wireless network, a computer device must be electrically connected to a wireless transceiver, so that the computer device can smoothly receive and transmit wireless network signals. The wireless transceiver must include at least one antenna for receiving and transmitting the wireless network signals, so that the wireless transceiver is capable of operating broadband signals and multiple bandwidths. Hence, in a current manufacturing method, several antennas are installed inside a casing of a wireless transceiver, and an antenna module is electrically coupled to a circuit board of the wireless transceiver, so that the wireless transceiver is capable of transferring the received wireless network signals to a micro-processing chip on the circuit board, or radiating the wireless signals generated by the micro-processing chip by the antennas. In another manufacturing method, the antenna is laid out on the circuit board of the wireless transceiver.

However, in actual application, the conventional external antenna module is so large in size that the overall volume of the wireless transceiver is too large. This is to say, the wireless transceiver is so large that the wireless transceivers cannot meet the current demands of being light in weight and small in size.

Otherwise, if the antenna module is laid out on the circuit board of the wireless transceiver, the antenna performance cannot be optimized, and if there are several antenna modules, the problem that the volume occupied by the wireless transceiver is too large to meet the current demands that the electronic products must be light in weight and small in size.

On the contrary, in order to keep the wireless transceiver to be light in weight and small in size, the volume of the antenna module needs to be limited below a certain scale, so that the operation band of the antenna module is limited, and even a problem of poor stability of a radiation pattern is generated.

Therefore, one of the most important research directions in the development of the antenna module is that how to design an antenna module having broadband and multi-band capabilities and meeting the demands of being light in weight, being small in size and having an omnidirectional radiation pattern.

SUMMARY

The disclosure provides an antenna module, which includes a center base, a first antenna, a second antenna, and a third antenna. The center base has a first extension leg, a second extension leg, and a third extension leg. The perimeter of the center base is divided into equal parts by the three extension legs extend from the center base. The first antenna extends from an end of the first extension leg opposite to the center base, the second antenna extends from an end of the second extension leg opposite to the center base and the third antenna extends from an end of the third extension leg opposite to the center base. Each of the first antenna, the second antenna, and the third antenna has a feed point, so as to receive and transmit at least one frequency band signal.

According to the antenna module of the disclosure, the first antenna, the second antenna, and the third antenna each comprises a support portion, an extension portion, a curved pin, and a radiation portion. The support portion of the first antenna extends from the first extension leg, the support portion of the second antenna extends from the second extension leg, and the support portion of the third antenna extends from the third extension leg. In each of the radiation portions, the extension portion extends from the support portion, the curved pin connects the extension portion to the radiation portion, and the radiation portion is used for receiving and transmitting the at least one frequency band signal.

According to the antenna module of the disclosure, each of the radiation portions includes a first radiation member, a second radiation member and a third radiation member. In each of the radiation portions, the third radiation member is connected to the first radiation member and faces the support portion with an interval, the first radiation member is connected to the second radiation member, the feed point is located at the second radiation member. The first radiation member receives and transmits a first frequency band signal through the feed point and the second radiation member receives and transmits a second frequency band signal through the feed point.

The disclosure further provides an antenna module, which comprises a center base, a first antenna, a second antenna, a third antenna, a fourth antenna, a fifth antenna, and a sixth antenna. The center base has a first extension leg, a second extension leg, a third extension leg, a fourth extension leg, a fifth extension leg, and a sixth extension leg. The extension legs divide the perimeter of the center base into equal parts and extend from the center base. The first antenna extends from an end of the first extension leg opposite to the center base, the second antenna extends from an end of the second extension leg opposite to the center base, the third antenna extends from an end of the third extension leg opposite to the center base, the fourth antenna extends from an end of the fourth extension leg opposite to the center base, the fifth antenna extends from an end of the fifth extension leg opposite to the center base, and the sixth antenna extends from an end of the sixth extension leg opposite to the center base. The first antenna, the second antenna, the third antenna, the fourth antenna, the fifth antenna, and the sixth antenna each has a feed pin, so as to receive and transmit at least one frequency band signal.

According to the antenna module of the present disclosure, the fourth antenna is disposed between the first antenna and the second antenna, the fifth antenna is disposed between the second antenna and the third antenna, and the sixth antenna is disposed between the first antenna and the third antenna.

According to the antenna module of the disclosure, the first antenna, the second antenna, and the third antenna are used for receiving a first frequency band signal, and the fourth antenna, the fifth antenna, and the sixth antenna are used for receiving a second frequency band signal.

Therefore, the efficacy of the disclosure is that the antenna module is designed as an integral structure, thus significantly reducing the volume of the antenna module, and reducing the complexity in the manufacturing process and the manufacturing cost.

According to the antenna module of the disclosure, several bodies of the antennas are jointly grounded through the center base, so as to enable the antenna module to have the broadband and multi-band capabilities, and meet the demands of being light in weight, small in size and having an omnidirectional radiation pattern.

BRIEF DESCRIPTION OF THE DRAWINGS

The present invention will become more fully understood from the detailed description given herein below for illustration only, and thus are not limitative of the present invention, and wherein.

DETAILED DESCRIPTION

Figure 1:
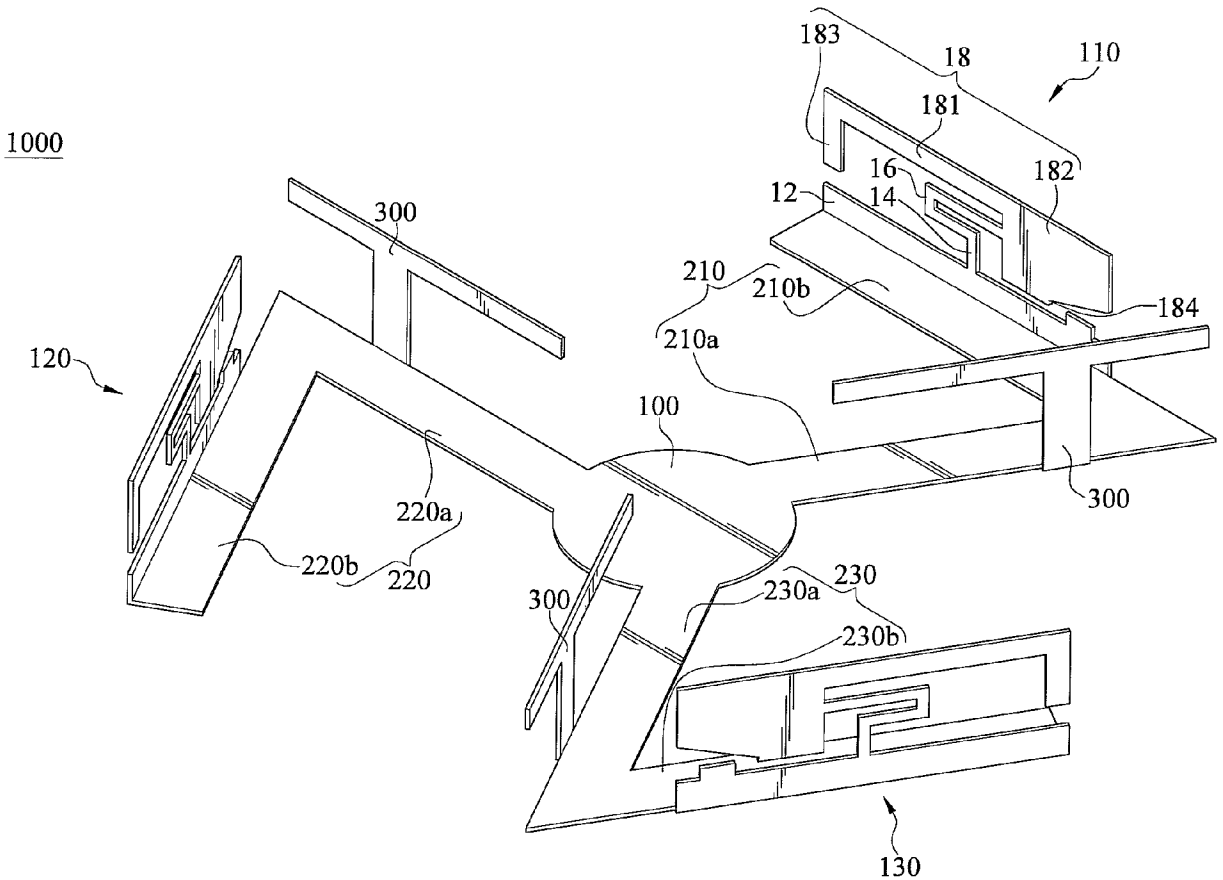
FIG. 1 is a schematic structural diagram of an antenna module according to a first embodiment of the disclosure.

FIG. 1 is a schematic structural diagram of an antenna module according to a first embodiment of the disclosure. The structure shown in FIG. 1 is formed by a single piece of conductive material, for example, a metal sheet. For the convenience of description, the antenna module is disassembled into multiple components for illustration.

The antenna module 1000 according to the first embodiment of the disclosure comprises a center base 100, a first antenna 110, a second antenna 120, and a third antenna 130. The center base 100 has a first extension leg 210, a second extension leg 220, and a third extension leg 230, which are formed by extending from the center base 100 respectively. The first extension leg 210, the second extension leg 220, and the third extension leg 230 are symmetrically arranged around the center base 100 and divide the perimeter of the center base 100 into equal parts.

The first extension leg 210 comprises a pair of a first extension portion 210*a* and a second extension portion 210*b*, the second extension leg 220 comprises a pair of a first extension portion 220*a* and a second extension portion 220*b*, and the third extension leg 230 comprises a pair of a first extension portion 230*a* and a second extension portion 230*b*. The first extension portions 210*a*, 220*a*, and 230*a* are connected to the center base 100, the second extension portions 210*b*, 220*b*, and 230*b* extend from the first extension portions 210*a*, 220*a*, and 230*a* respectively. Each pair of the first extension portions 210*a*, 220*a*, and 230*a* and the second extension portions 210*b*, 220*b*, and 230*b* substantially form an L-shaped structure.

The first antenna 110 extends from an end (that is, the second extension portion 210*b*) of the first extension leg 210 opposite to the center base 100, the second antenna 120 extends from an end (that is, the second extension portion 220*b*) of the second extension leg 220 opposite to the center base 100, and the second antenna 130 extends from an end (that is, the second extension portion 230*b*) of the third extension leg 230 opposite to the center base 100. In this way, the antenna module 1000 according to the first embodiment is formed with the first antenna 110, the second antenna 120, and the third antenna 130 symmetrically disposed around the center base 100.

As the first antenna 110, the second antenna 120, and the third antenna 130 are designed to be the same structure, for the convenience of description of the embodiments, only the first antenna 110 disassembled into multiple components is described in detail below.

It can be seen in FIG. 1 that, the first antenna 110 comprises a support portion 12, an extension portion 14, a curved pin 16, and a radiation portion 18. The radiation portion 18 comprises a first radiation member 181, a second radiation member 182, and a third radiation member 183. The second radiation member 182 has a feed point 184 at a side of the second radiation member 182 opposite to the support portion 12, and the feed point 184 is used for receiving and transmitting radio frequency (RF) signals. The first radiation member 181 is connected to the second radiation member 182. The third radiation member 183 is connected to the first radiation member 181 and extends towards the support portion 12 but faces the support portion 12 with an interval. The feed point 184 is fed the signal through a signal wire. The signal wire comprises a signal core, an insulation layer wrapping the signal core, and a grounding layer wrapping the insulation layer. The signal core is connected to the feed point 184, and the grounding layer is connected to the support portion 12 opposite to the feed point 184. In this way, the first radiation member 181 and the second radiation member 182 may receive and transmit a first frequency band signal and a second frequency band signal through the feed point 184 respectively.

For example, the first frequency band signal may be an RF signal having a frequency of 5 GHz (Gigahertz), and the second frequency band signal may be an RF signal having a frequency of 2.4 GHz. Therefore, the first antenna 110, the second antenna 120, and the third antenna 130 according to the embodiment of the present invention may be, but are not limited to, dual-band antennas.

In particular, the extension portion 14 extends from the support portion 12, and the curved pin 16 connected the extension portion 14 to the second radiation member 182 of the radiation portion 18. The curved pin 16 is substantially in a U shape. The support portion 12 of the first antenna 110 extends from the second extension portion 210*b* of the first extension leg 210, a support portion 12 of the second antenna 120 extends from the second extension portion 220*b* of the second extension leg 220, and a support portion 12 of the third antenna 130 extends from the second extension portion 230 of the third extension leg 230. In this way, the center base 100, the first extension leg 210, the second extension leg 220, the third extension leg 230, the first antenna 110, the second antenna 120, and the third antenna 130 form an integral antenna module, thereby significantly reducing the difficulty and the cost of manufacturing the antenna module.

In addition, according to the first embodiment of the disclosure, the antenna module 1000 further comprises grounding portions 300, the grounding portions 300 vertically extend from the first extension portions 210*a*, 220*a*, and 230*a* and the grounding portion 300 are substantially in T-shaped. The shape of the grounding portion 300 is not intended to limit the scope of the present invention. In other embodiments, the grounding portion 300 may also be alternatively designed as an L shape.

Figure 2:
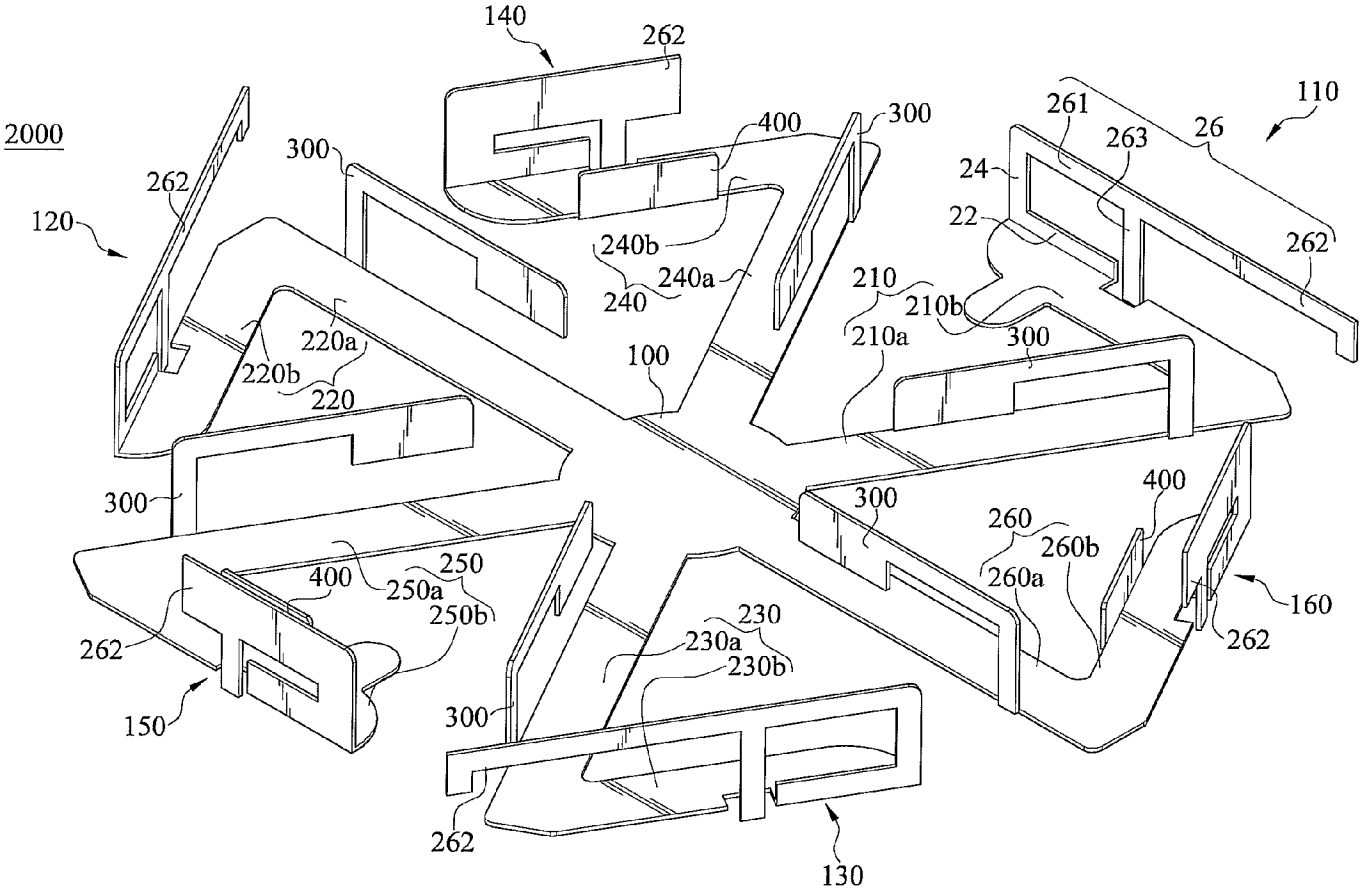
FIG. 2 is a schematic structural diagram of an antenna module according to a second embodiment of the disclosure.

FIG. 2 is a schematic structural diagram of an antenna module according to a second embodiment of the disclosure.

The structure shown in FIG. 2 is formed from a single piece of conductive material, for example, a metal sheet. For the convenience of description, the antenna module is disassembled into multiple components for illustration.

The antenna module 2000 according to the second embodiment of the disclosure comprises a center base 100, a first antenna 110, a second antenna 120, a third antenna 130, a fourth antenna 140, a fifth antenna 150, and a sixth antenna 160. The center base 100 has a first extension leg 210, a second extension leg 220, a third extension leg 230, a fourth extension leg 240, a fifth extension leg 250, and a sixth extension leg 260, which are formed by extending from the center base 100 respectively. The first extension leg 210, the second extension leg 220, the third extension leg 230, the fourth extension leg 240, the fifth extension leg 250, and the sixth extension leg 260 are symmetrically arranged around the center base 100 and divide the perimeter of the center base 100 into equal parts.

The fourth antenna 140 is disposed between the first antenna 110 and the second antenna 120, the fifth antenna 150 is disposed between the second antenna 120 and the third antenna 130, and the sixth antenna 160 is disposed between the first antenna 110 and the third antenna 130.

The first extension leg 210 comprises a pair of a first extension portion 210*a* and a second extension portion 210*b*, the second extension leg 220 comprises a pair of a first extension portion 220*a* and a second extension portion 220*b*, the third extension leg 230 comprises a pair of a first extension portion 230*a* and a second extension portion 230*b*, the fourth extension leg 240 comprises a pair of a first extension portion 240*a* and a second extension portion 240*b*, the fifth extension leg 250 comprises a pair of a first extension portion 250*a* and a second extension portion 250*b*, and the sixth extension leg 260 comprises a pair of a first extension portion 260*a* and a second extension portion 260*b*.

The first extension portions 210*a*, 220*a*, 230*a*, 240*a*, 250*a*, and 260*a* are connected to the center base 100 respectively, and the second extension portions 210*b*, 220*b*, 230*b*, 240*b*, 250*b*, and 260*b* extend from the first extension portions 210*a*, 220*a*, 230*a*, 240*a*, 250*a*, and 260*a* respectively. Each pair of the first extension portion and the second extension portion substantially forms an L-shaped structure.

The first antenna 110 extends from an end (that is, the second extension portion 210*b*) of the first extension leg 210 opposite to the center base 100, the second antenna 120 extends from an end (that is, the second extension portion 220*b*) of the second extension leg 220 opposite to the center base 100, the third antenna 130 extends from an end (that is, the second extension portion 230*b*) of the third extension leg 230 opposite to the center base 100, the fourth antenna 140 extends from an end (that is, the second extension portion 240*b*) of the fourth extension leg 240 opposite to the center base 100, fifth antenna 150 extends from an end (that is, the second extension portion 250*b*) of the fifth extension leg 250 opposite to the center base 100, and the sixth antenna 160 extends from an end (that is, the second extension portion 260*b*) of the sixth extension leg 260 opposite to the center base 100. In this way, the first antenna 110, the second antenna 120, the third antenna 130, the fourth antenna 140, the fifth antenna 150, and the sixth antenna 160 are symmetrically disposed around the center base 100 to be formed as a part of the antenna module 2000.

As the first antenna 110, the second antenna 120, the third antenna 130, the fourth antenna 140, the fifth antenna 150, and the sixth antenna 160 are designed to be the same structure, for the convenience of description of the embodiments, only the first antenna 110 disassembled into multiple components is described in detail below.

It can be seen in FIG. 2 that, the first antenna 110 comprises a support portion 22, a connection portion 24, and a radiation portion 26. The connection portion 24 is connected to the radiation portion 26 and the support portion 22. The support portion 22 of the first antenna 110 extends from the second extension portion 210*b* of the first extension leg 210, a support portion 22 of the second antenna 120 extends from the second extension portion 220*b* of the second extension leg 220, a support portion 22 of the third antenna 130 extends from the second extension portion 230*b* of the third extension leg 230, a support portion 22 of the fourth antenna 140 extends from the second extension portion 240*b* of the fourth extension leg 240, a support portion 22 of the fifth antenna 150 extends from the second extension portion 250*b* of the fifth extension leg 250, and a support portion 22 of the sixth antenna 160 extends from the second extension portion 260*b* of the sixth extension leg 260.

The radiation portion 26 comprises a first radiation member 261, a second radiation member 262, and a feed pin 263. The feed pin 263 connects the first radiation member 261 and the second radiation member 262 and the feed pin 263 extends towards the support portion 22. The feed pin 263 faces the connection portion 24 with an interval. In this way, the radiation portion 26 may receive and transmit at least one frequency band signal through the feed pin 263.

Opposite extension arrangement of the feed pin 263 and the support portion 22 may be designed according to actual requirements. For example, the feed pin 263 in FIG. 2 extends towards the support portion 22 to shorten the lateral length of the support portion 22.

As shown in FIG. 2, the length of the second radiation members 262 of the first antenna 110, the second antenna 120 and the third antenna 130 is different from that of the second radiation members 262 of the fourth antenna 140, the fifth antenna 150 and the sixth antenna 160. Therefore, by adjusting the lengths of the second radiation member 262 of the antennas, the first antenna 110, the second antenna 120 and the third antenna 130 is used for receiving and transmitting a first frequency band signal, and the fourth antenna 140, the fifth antenna 150 and the sixth antenna 160 is used for receiving and transmitting a second frequency band signal. The first frequency band signal may be an RF signal having a frequency of 2.4 GHz, but is not limited to the above-mentioned frequency. The second frequency band signal may be an RF signal having a frequency of 5 GHz, but is not limited to the above-mentioned frequency. Therefore, the antenna module 2000 according to the second embodiment of the disclosure is formed with two antenna groups, and each group comprises three antennas for receiving and transmitting different frequency band signals.

Moreover, the first extension leg 210, the second extension leg 220, the third extension leg 230, the fourth extension leg 240, the fifth extension leg 250, the sixth extension leg 260, the first antenna 110, the second antenna 120, the third antenna 130, the fourth antenna 140, the fifth antenna 120, and the sixth antenna 160 of the antenna module 2000 are integrally formed, thereby significantly reducing the difficulty and the cost of manufacturing the antenna module.

In addition, in order to enable the antenna module 2000 to provide a better radiation pattern, the antenna module 2000 further comprises a grounding portion 300, formed by vertically extending from the first extension portions 210*a*, 220*a*, 230*a*, 240*a*, 250*a*, and 260*a* and substantially having a L-shaped structure. The shape of the grounding portion 300 is not intended to limit the scope of the present invention. In other embodiments, the grounding portion 300 may also be alternatively designed as a T shape.

Furthermore, in order to achieve better impedance matching of the antenna, the antenna module 2000 may further comprise an impedance matching portion 400, the impedance matching portion 400 vertically extends from the second extension portions 240*b*, 250*b*, and 260*b* of the fourth extension leg 240, the extension leg 250, and the sixth extension leg 260 and facing to the fourth antenna 140, the fifth antenna 150 and the sixth antenna 160 with an interval. In this way, the antenna module 2000 can effectively match the impedance to 50 ohms.

To sum up, the antenna module according to the disclosure is an integral structure formed by directly bending a single metal plate, thereby significantly reducing the volume of the antenna module and reducing the difficulty and the cost of manufacturing the antenna module.

The antenna module of the present invention, through the design of the symmetrical center base and antenna group, several bodies of the antennas are grounded jointly to receive and transmit more than two different frequency band signals, thus greatly increasing the application range of the antenna module.

What is claimed is:

1. An antenna module, comprising:

a center base, having a first extension leg, a second extension leg, and a third extension leg, wherein the extension legs divide the perimeter of the center base into equal parts and extends from the center base, the center base having a first surface and a second surface opposite to the first surface, the first extension leg, the second extension leg, and the third extension leg each has a first extension portion and a second extension portion, the first extension portions are connected to the center base, and the first extension portion and the second extension portion of each extension leg form an L-shaped structure;

a first antenna, a second antenna, and a third antenna, wherein the first antenna extends from an end of the first extension leg opposite to the center base, the second antenna extends from an end of the second extension leg opposite to the center base, the third antenna extends from an end of the third extension leg opposite to the center base, and the first antenna, the second antenna, and the third antenna each has a feed point, the feed points are used for receiving and transmitting at least one frequency band signal; and a plurality of grounding portions, wherein each of the grounding portions extend from the first extension portion, the first antenna, the second antenna, and the third antenna extend from the second extension portions of the first extension leg, the second extension leg, and the third extension leg respectively;

wherein the center base, the first extension leg, the second extension leg, the third extension leg, the first antenna, the second antenna, the third antenna and the grounding portions are formed from a single piece of a metal sheet; and wherein an extending direction of the first extension portion of the first extension leg, an extending direction of the first extension portion of the second extension leg and an extending direction of the first extension portion of the third extension leg are orthogonal to the normal direction of the first surface, an extending direction of the first antenna, an extending direction of the second antenna and an extending direction of the third antenna are parallel to the normal direction of the first surface, and the first antenna, the second antenna and the third antenna extends along the normal direction of the first surface from the center base, the grounding portions vertically extend from the first extension portions respectively and are substantially a T-shaped structure.

2. The antenna module according to claim 1, wherein the first antenna, the second antenna, and the third antenna each comprises a support portion, an extension portion, a curved pin, and a radiation portion, the support portion of the first antenna extends from the first extension leg, the support portion of the second antenna extends from the second extension leg, the support portion of the third antenna extends from the third extension leg, the extension portion of each of the antennas extends from the support portion, the curved pin of each of the antennas connects the extension portion and the radiation portion of each of the antennas, and the radiation portion of each of the antennas is used for receiving and transmitting the frequency band signal.

3. The antenna module according to claim 2, wherein the radiation portion of each of the antennas comprises a first radiation member, a second radiation member and a third radiation member, in each of the radiation portions, the third radiation member is connected to the first radiation member and faces the support portion with an interval, the first radiation member is connected to the second radiation member, the feed point is located at the second radiation member, each of the first radiation members receives and transmits a first frequency hand signal through the feed points, and each of the second radiation members receives and transmits a second frequency band signal through the feed points.

4. The antenna module according to claim 1, wherein the center base, the first extension leg, the second extension leg, the third extension leg, the first antenna, the second antenna, and the third antenna are integrally formed.

5. An antenna module, comprising:

a center base, having a first extension leg, a second extension leg, a third extension leg, a fourth extension leg, a fifth extension leg, and a sixth extension leg, wherein the extension legs divide the perimeter of the center base into equal parts and extend from the center base, the center base having a first surface and a second surface opposite to the first surface, the first extension leg, the second extension leg, the third extension leg, the fourth extension leg, the fifth extension leg, and the sixth extension leg each has a first extension portion and a second extension portion, each of the first extension portions is connected to the center base, and the first extension portion and the second extension portion of each extension leg generally form an L-shaped structure;

a first antenna, a second antenna, a third antenna, a fourth antenna, a fifth antenna, and a sixth antenna, wherein the first antenna extends from an end of the first extension leg opposite to the center base, the second antenna extends from an end of the second extension leg opposite to the center base, the third antenna extends from an end of the third extension leg opposite to the center base, the fourth antenna extends from an end of the fourth extension leg opposite to the center base, the fifth antenna extends from an end of the fifth extension leg opposite to the center base, the sixth antenna extends from an end of the sixth extension leg opposite to the center base, and the first antenna, the second antenna, the third antenna, the fourth antenna, the fifth antenna, and the sixth antenna each has a feed pin, the feed pins are used for receiving and transmitting at least one frequency band signal; and a plurality of grounding portions, wherein each of the grounding portions extends from each of the first extension portions, and the first antenna, the second antenna, the third antenna, the fourth antenna, the fifth antenna, and the sixth antenna extend from the second extension portions of the first extension leg, the second extension leg, the third extension leg, the fourth extension leg, the fifth extension leg, and the sixth extension leg respectively;

wherein the center base, the first extension leg, the second extension leg, the third extension leg, the fourth extension leg, the fifth extension leg, the sixth extension leg, the first antenna, the second antenna, the third antenna, the fourth antenna, the fifth antenna, the sixth antenna and the grounding portions are formed from a single piece of a metal sheet; and wherein an extending direction of the first extension portion of the first extension leg, an extending direction of the first extension portion of the second extension leg, an extending direction of the first extension portion of the third extension leg, an extending direction of the first extension portion of the fourth extension leg, an extending direction of the first extension portion of the fifth extension leg and an extending direction of the first extension portion of the sixth extension leg are orthogonal to the normal direction of the first surface, an extending direction of the first antenna, an extending direction of the second antenna, an extending direction of the third antenna, an extending direction of the fourth antenna, an extending direction of the fifth antenna and an extending direction of the sixth antenna are parallel to the normal direction of the first surface, and the first antenna, the second antenna, the third antenna, the fourth antenna, the fifth antenna and the sixth antenna extend along the normal direction of the first surface from the center base, each of the grounding portions vertically extends from each of the first extension portions and is substantially an L-shaped structure.

6. The antenna module according to claim 5, further comprising a plurality of impedance matching portions, each of impedance matching portions extends from the second extension portions of the fourth extension leg, the fifth extension leg, and the sixth extension leg, and face the fourth antenna, the fifth antenna, and the sixth antenna and are spaced therefrom.

7. The antenna module according to claim 6, wherein the impedance matching portions, the first antenna, the second antenna, the third antenna, the fourth antenna, the fifth antenna, and the sixth antenna are formed by vertically extending from the second extension portions.

8. The antenna module according to claim 5, wherein the first antenna, the second antenna, the third antenna, the fourth antenna, the fifth antenna, and the sixth antenna each comprises a support portion, a connection portion and a radiation portion, the support portion of the first antenna extends from the first extension leg, the support portion of the second antenna extends from the second extension leg, the support portion of the third antenna extends from the third extension leg, the support portion of the fourth antenna extends from the fourth extension leg, the support portion of the fifth antenna extends from the fifth extension leg, the support portion of the sixth antenna extends from the sixth extension leg, the connection portion of each of the antennas connects the support portion and the radiation portion of each of the antennas, and the radiation portion of each of the antenna is used for receiving and transmitting the frequency band signal.

9. The antenna module according to claim 8, wherein each of the radiation portions comprises a first radiation member, a second radiation member, and the feed pin, in each of the radiation portions, the feed pin connects the first radiation member and the second radiation member and faces the connection portion with an interval, and the feed pins extend towards the support portion.

10. The antenna module according to claim 5, wherein the first antenna, the second antenna, and the third antenna are used for receiving and transmitting a first frequency band signal, and the fourth antenna, the fifth antenna, and the sixth antenna are used for receiving and transmitting a second frequency band signal.

11. The antenna module according to claim 10, wherein the fourth antenna is disposed between the first antenna and the second antenna, the fifth antenna is disposed between the second antenna and the third antenna, and the sixth antenna is disposed between the first antenna and the third antenna.

* * * * *